US008257522B2

(12) United States Patent
Racette et al.

(10) Patent No.: US 8,257,522 B2
(45) Date of Patent: Sep. 4, 2012

(54) BLACK POWDER SUBSTITUTES FOR SMALL CALIBER FIREARMS

(76) Inventors: Mathieu Racette, Glen Walter (CA); Staphane Viau, St. Chrysostome (CA); Daniel Lepage, Coteau-du-Lac (CA)

( * ) Notice: Subject to any disclaimer, the term of this patent is extended or adjusted under 35 U.S.C. 154(b) by 0 days.

(21) Appl. No.: 13/326,931

(22) Filed: Dec. 15, 2011

(65) Prior Publication Data

US 2012/0138200 A1 Jun. 7, 2012

Related U.S. Application Data

(62) Division of application No. 12/278,832, filed as application No. PCT/CA2007/000175 on Feb. 9, 2007, now Pat. No. 8,042,470.

(60) Provisional application No. 60/771,443, filed on Feb. 9, 2006.

(51) Int. Cl.

| | |
|---|---|
| ***C06B 31/00*** | (2006.01) |
| ***C06B 29/00*** | (2006.01) |
| ***D03D 23/00*** | (2006.01) |
| ***D03D 43/00*** | (2006.01) |

(52) U.S. Cl. ..... 149/109.4; 149/45; 149/75; 149/109.2

(58) Field of Classification Search ..... 149/45, 149/75, 109.2, 109.4

See application file for complete search history.

(56) References Cited

U.S. PATENT DOCUMENTS

| | | | | |
|---|---|---|---|---|
| 2,379,056 | A * | 6/1945 | Alexander | 102/430 |
| 3,814,017 | A * | 6/1974 | Backstein et al. | 102/215 |
| 5,078,051 | A * | 1/1992 | Amundson | 102/206 |
| 5,104,973 | A * | 4/1992 | Kondo et al. | 530/334 |
| 5,868,424 | A * | 2/1999 | Hamilton et al. | 280/741 |
| 6,725,781 | B2 * | 4/2004 | Niemeyer et al. | 102/472 |
| 2001/0042578 | A1 * | 11/2001 | O'Meara et al. | 149/96 |

* cited by examiner

*Primary Examiner* — James McDonough

(74) *Attorney, Agent, or Firm* — Harvey S. Kauget; Phelps Dunbar LLP

(57) ABSTRACT

Propellant compositions are provided herein for use in small arms cartridges. Such propellant compositions include a cellulose-based organic fuel, a non-azide, nitrogen-containing primary organic oxidizer and a secondary nitrate, perchlorate, chlorate of peroxide oxidizer. Preferably, such compositions are in the form of extruded shaped hollow cylindrical grains having dimensions that makes it loadable in a muzzleloader firearm or small calibre firearm cartridge case. Ignition grains are also provided for use alone or in a mixture with the propellant compositions. When used in a small calibre firearm or muzzleloader, the temperature of combustion is at a level that ensures substantially complete combustion of the fuel during firing so that the products of combustion are mostly gaseous.

6 Claims, 4 Drawing Sheets

BLACK POWDER SUBSTITUTES FOR SMALL CALIBER FIREARMS

CROSS REFERENCES TO RELATED APPLICATIONS

This application is a divisional of commonly owned U.S. Utility patent application Ser. No. 12/278,832 filed Dec. 17, 2008; now U.S. Pat. No. 8,042,470 entitled: REMOTE SETTING FOR ELECTRONIC SYSTEMS IN A PROJECTILE FOR CHAMBERED AMMUNITION, which is a 371 of PCT/CA07/00175 filed Feb. 9, 2007, which was filed based on U.S. Provisional Application 60/771,443 filed Feb. 9, 2006, this Utility patent Application incorporated by reference herein.

FIELD OF INVENTION

This invention relates both to low-smoke, low-hygroscopic propellant compositions and to a shaped mass thereof for use in small caliber firearms, including modern in-line muzzle-loaders, and to methods for the production of such shaped masses.

BACKGROUND OF THE INVENTION

Black powder, typically a mixture of sulphur, potassium nitrate and charcoal, was the gunpowder of choice for several hundred years dating from, at least, in the mid-14$^{th}$ century until efforts to develop alternatives were begun in recent times. Black powder suffers from a number of major drawbacks, including inefficient combustion that produces large amounts of smoke upon firing, fouling of the weapon from particulate residues, and poor hygroscopic characteristics. These deficiencies were largely eliminated for high chamber pressure weapons by the invention by Paul Vieille in 1886 of smokeless gunpowder, made from gelatinized nitro-cellulose mixed with ether and alcohol. Subsequent improvements soon led to cordite, containing 58% nitroglycerin, 37% guncotton and 5% petroleum jelly, all in percentage by weight, patented by Abel and Dewar in 1889. Guns using these powders produced substantially only gaseous combustion products; hence they emitted practically no smoke when fired. In addition, smokeless gunpowder was much more powerful than black powder, giving an accurate rifle range of up to 1000 yards (914.4 meters).

It was not, and still is not, possible to use such high energy smokeless powders in many types of sporting guns that are unable to withstand the high pressures developed. Hence, black powder has continued to be utilized in "cowboy action" and muzzle loading sporting firearms, amongst others, despite its drawbacks.

DESCRIPTION OF THE PRIOR ART

U.S. Pat. No. 4,128,443 patented Dec. 5, 1978, by D. E. Pawlak et al described a powder that combined the low pressure characteristics of black powder and the safe handling and storage properties of smokeless powder. This powder, now marketed under the trademark "PYRODEX", is a homogeneous mixture of 30 to 82.5 parts by weight of a nitrate, chlorate or perchlorate oxidizing agent (preferably potassium perchlorate), 14.5 to 45 parts by weight of an oxidizable derivative of an organic carboxylic acid (preferably sodium benzoate), and 1.0 to 25.0 parts by weight water. Compared to black powder, PYRODEX™ produced less smoke while increasing the velocity of the bullets fired. The chamber pressure was at a low enough level to be utilized in muzzle loading and low-energy sporting weapons.

Another advance in the state of the art was described in U.S. Pat. No. 4,997,496, patented Mar. 5, 1991 by Hoffmann-La Roche Inc. That patent described an explosive and propellant composition which was obtained by admixing finely divided particles of ascorbic acid and a nitrate-containing oxidizing agent, such as potassium nitrate. Such dry powder was said to be used as such or in a compressed form in "various explosive or propellant applications", such as consumable cartridges. This patent led to the marketing in North America of the powder under the trademark "BLACK CANYON" for use in, for example, antique firearms or other weapons that cannot sustain high operating pressures. Recent improvements in ignition systems have made this powder more attractive for sporting firearms, particularly newer models that are designed to operate at higher pressures.

As described above, both PYRODEX™ and BLACK CANYON™ powders, including a number of derivatives stemming from the latter, are of the same basic makeup as black powder in that they all contain oxidizers and/or fuels that are minerals. It is well known that mineral-based oxidizers and fuels used in powders suffer from certain disadvantages. They all tend to emit some smoke when fired, they all tend to foul the weapon when fired, and they all are hygroscopic. PYRODEX™ and BLACK CANYON™ (including its derivatives) have improved characteristics over black powder, but they still suffer from those disadvantages. These and other propellant compositions of the prior art require the user to clean the weapon after every or almost every shot fired, regardless of the weather conditions.

Other patents which disclose improvements to propellant compositions still suffer from various drawbacks. Another industry using gas generating compositions that requires minimal post-combustion residue is in vehicle air bag systems. These systems comprise filters to minimize or eliminate residue. See for example the compositions described in U.S. Pat. Nos. 6,860,951; 6,846,373; 6,627,014; 6,533,878; 6,497,774; 5,985,060; 5,780,768; 5,501,152 and 5,125,684.

U.S. Pat. No. 6,860,951 describes an oxidizer-fuel mixture comprising a cellulose-based fuel and an oxidizer such as a mixture of ammonium perchlorate and sodium nitrate such that the combination is a solid solution. The mixture is described as producing up to 30% solids on combustion, which may be appropriate for use in a vehicle air bag passive restraint system.

The gas-generating compositions disclosed in U.S. Pat. No. 6,846,373 comprise ammonium nitrate, metal oxyacid salt, ammonium perchlorate and a combusting component such as charcoal. The combustion residue from these compositions is described as being either a neutral alkali metal chloride or an alkali earth metal chloride.

Other patents of the prior art which describe propellants for use in firearms, such as U.S. Pat. Nos. 6,045,638; 6,024,812; 3,909,322 and 3,031,347 are not suitable for use in small caliber firearms.

Given the problems of the prior art, it would be desirable to provide a propellant for use in firearms requiring low chamber pressures which can generate the proper pressure-time profile upon ignition and while the projectile is still in the barrel. In particular, it would be desirable to provide relatively smokeless and residue-free substitutes for classic black powder or similar mineral-based powders. Such a propellant should be able to fire with consistency and have an acceptable shelf life for its purpose, which usually requires that it not be highly hygroscopic. Additionally, such a propellant should respect regulatory requirements for transportation and be relatively safe for users who engage in self-loading for shooting purposes, both in terms of its capacity for unexpected ignition and its toxicity. To meet these requirements it would be desirable, in summary, to provide a propellant that:

is smokeless. For this objective, the propellant would purposefully exclude the presence of substantial quantities of mineral oxidizers and fuels such as those used in black powder, PYRODEX™ and BLACK CANYON™ and its derivatives;

is a substantially organic formulation which would produce mostly gases as combustion products, as do smokeless gun powders, and which would operate at pressures low enough for use in small caliber firearms such as caliber 0.50 modern in-line muzzleloaders and guns having "cowboy actions" (e.g., the 45-70 GVT);

has a pressure-time curve similar to that for black powder under the same firing conditions;

is relatively non-hygroscopic compared to black powder or similar mineral-based substitutes;

has ballistic characteristics similar to those associated with black powder or similar mineral-based powders;

is relatively temperature insensitive compared to black powder or similar mineral-based powders; and is controllable as to its bulk density and specific energy so that essentially the same volumetric charges as those for black powder or its substitutes yield similar ballistic properties.

The invention hereafter described is intended to address these desirable objectives.

The invention in its general form will first be described, and then its implementation in terms of specific embodiments will be detailed with reference to the drawings following hereafter. These embodiments are intended to demonstrate the principle of the invention, and the manner of its implementation. The invention in its broadest and more specific forms will then be further described, and defined, in each of the individual claims which conclude this Specification.

SUMMARY OF THE INVENTION

A broad aspect of one embodiment of the present invention provides a cellulose-based organic fuel in an amount from about 70 to 90% by weight, a non-azide, nitrogen-containing primary organic oxidizer in an amount from about 5% to about 30% by weight, and a secondary nitrate, perchlorate, chlorate or peroxide oxidizer in an amount up to about 10% by weight, preferably from about 0.5% to about 10% by weight, wherein as a preferred objective, when used in a small caliber firearm or muzzleloader, the temperature of combustion is at a level that provides substantially complete combustion of the propellant during firing, preferably before the projectile leaves the muzzle, so that the products of combustion are mostly gaseous.

The cellulose-based organic fuel of the present invention is chosen from the group comprising nitrocellulose, cellulose, cellulose esters or cellulose ethers, and preferably is nitrocellulose. The non-azide, nitrogen-containing primary organic oxidizer is chosen from the group comprising guanidine nitrate, nitroguanidine, triaminoguanidine, diaminoguanidine, monoaminoguanidine or nitroaminotetrazole salts, and preferably is guanidine nitrate. The secondary nitrate, perchlorate, chlorate or peroxide oxidizer comprises: potassium nitrate, sodium nitrate, ammonium nitrate, lithium nitrate or any other alkali metal oxidizer, or barium nitrate, magnesium nitrate, calcium nitrate or any other alkaline earth metal oxidizer; potassium perchlorate, sodium perchlorate, ammonium perchlorate, lithium perchlorate or any other alkali metal oxidizer, or barium perchlorate, magnesium per-chlorate, calcium perchlorate or any other alkaline earth metal oxidizer; potassium chlorate, sodium chlorate, ammonium chlorate, lithium chlorate or any other alkali metal oxidizer, or barium chlorate, magnesium chlorate, calcium chlorate or any other alkaline earth metal oxidizer or any alkaline metal peroxide or any alkaline earth metal peroxide. The preferred secondary nitrate, perchlorate, chlorate or peroxide oxidizer is potassium perchlorate.

In one particular embodiment, nitrocellulose is present in an amount of about 76% to about 82% by weight, guanidine nitrate is present in an amount of about 10 to about 20% by weight, and potassium perchlorate is present in an amount of about 0.8 to about 2.0% by weight. In another particular embodiment, the nitrocellulose is present in an amount of about 79.2% by weight, the guanidine nitrate is present in an amount of about 15% by weight and the potassium perchlorate is present in an amount of about 1.5% by weight.

A broad aspect of another embodiment of the present invention provides an extrudable propellant composition as described in combination with a suitable solvent and further containing from about 1.0% to about 4.0% by weight of a plasticizer, from about 1.0% to about 3.0% by weight of a stabilizer, and up to about 0.8% by weight of a lubricant, with the preferred objective that, when used in a small caliber firearm or muzzleloader, the temperature of combustion is at a level that provides substantially complete combustion of the propellant during firing, before the projectile leaves the muzzle, so that the products of combustion are mostly gaseous.

The solvent can be an acetone alcohol/mixture, an ether/alcohol mixture, an ethyl acetate/alcohol mixture or other suitable solvent. The plasticizer can be any substance capable of gelatinizing nitrocellulose or cellulose-based binders such as polyvinyl alcohol, triacetin, polyester adipate or sebacate or dinitrotoluene or acetyl triethyl citrate or any other citrate or dibutyl phthalate or any other phthalate. The stabilizer can be a NO scavenging substance such as diphenylamine, methyl diphenyl urea (i.e., akardite), 2-NO diphenylamine, N-methyl-p-nitroaniline, diethyl diphenyl urea (i.e., ethyl centralite) or their equivalent. The preferred stabilizer is ethyl centralite. The lubricant can be graphite or molybdenum disulfide.

In one particular embodiment, the solvent is an ether/alcohol mixture, the plasticizer is acetyl triethyl citrate, the stabilizer is ethyl centralite and the lubricant is graphite. In another particular embodiment, the solvent is an ether/alcohol mixture, the plasticizer is acetyl triethyl citrate in an amount of about 2.0% to about 3.0% by weight, the stabilizer is ethyl centralite in an amount of about 1.5% to about 2.5% by weight; and the lubricant is graphite in an amount of up to about 0.3% by weight. In yet another particular embodiment, the solvent is an ether/alcohol mixture, the plasticizer is acetyl triethyl citrate in an amount of about 2.0% by weight, the stabilizer is ethyl centralite in an amount of about 2.0% by weight, and the lubricant is graphite in an amount of about 0.2% by weight.

In another particular embodiment, the shaped (e.g., extruded) form of the composition can be colour coded by the addition of up to about 0.1% by weight of a suitable pigment.

A broad aspect of another embodiment of the present invention provides a propellant composition as described mixed together with grains of an ignition material. A broad aspect of another embodiment of the present invention provides a propellant composition comprising only the ignition grain material described.

In one particular embodiment, the propellant-ignition mixture is in a 1:1 ratio by volume.

In another particular embodiment, the ignition grain material comprises nitrocellulose in an amount from about 40 to 50% by weight, ethyl centralite in an amount from 0.2 to 0.8% by weight, potassium nitrate in an amount from about 36 to 46% by weight, sulphur in an amount from about 3.5 to 7.5% by weight, charcoal from about 5.5 to 10.5% by weight and other moisture and volatiles in an amount up to 1.0% by weight.

A broad aspect of another embodiment of the present invention provides a method of producing free-flowing grains by shaping a propellant composition, preferably by extrusion, for use in small arms cartridges or modern in-line muzzle-loaders, the propellant composition comprising: the cellulose-based organic fuel, primary organic oxidizer, secondary oxidizer, plasticizer, stabilizer and lubricant as described. This method preferably includes extruding a plastic mass of the composition through a die that forms a hollow void in the extruded mass whereby, on severing segments of the extruded composition immediately after said extrusion step while the extruded composition is still in a plastic phase, extruded grains so formed have a hollow void in their interior.

In one particular embodiment, an extrusion die which will produce at least one through hole in the hollow cylindrical grains, is formed by one or more mandrels or needles. A broad aspect of a further embodiment of the present invention provides shaped grains of the propellant composition as described in detail herein to provide a propellant charge having a bulk density in the range of 0.550 g/cc to 0.750 g/cc. The bulk density of the grains may be controlled by the size of the hollow void formed in the interior.

A broad aspect of another embodiment of the present invention provides shaped grains of the propellant composition as described in detail herein to provide a propellant charge having an effective energy per unit volume in the range of 400 cal/cc to 700 cal/cc. The effective energy per unit volume of the grains may be controlled by the size of a hollow void formed in the interior.

A broad aspect of yet another embodiment of the present invention provides shaped hollow grains of the propellant composition as described in detail herein having a length in the range of 0.030 inch (0.0762 centimeters) to 0.200 inch (0.508 centimeters), a diameter in the range 0.040 inch (0.1016 centimeter) to 0.070 inch (0.1778 centimeters), and having a coaxial opening there through having a diameter in the range 0.010 inch (0.0254 centimeters) to 0.040 inch (0.1016 centimeters).

A broad aspect of still another embodiment of the present invention provides a powder load containing the shaped grains as described in detail herein in conjunction with a projectile.

Thus, as described above, the principal ingredients of the propellant composition of the present invention, which are its fuel and its principal oxidizer, are organic in nature.

DETAILED DESCRIPTION

Terminology

Figure 1:
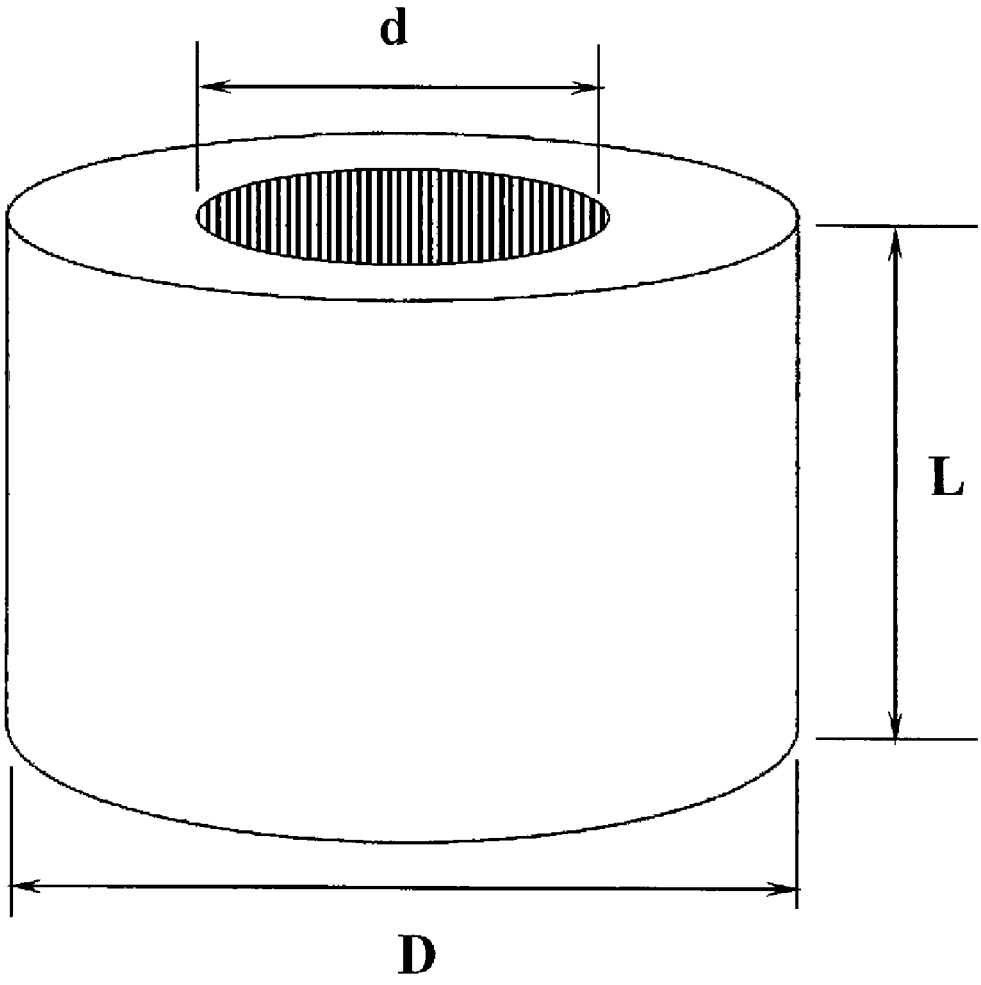
FIG. 1 is an isometric view of a grain of the propellant as shaped according to a preferred aspect of the invention.

A summary of certain terms used herein is provided to reduce some of the potential questions with regard to those terms, as they are used in the specification and claims. It is to be understood that this summary is provided to assist with understanding how the terms relate to each other, but the summary does not restrict the meaning of the terms. The figures and specification more fully establish the meaning for the terms.

"Effective energy per unit volume" means the "work done on the projectile" upon firing.

"Mineral" means substances which are not organic and which contain a metallic component such as calcium, manganese, magnesium, nickel, copper, silver, zinc, iron, cobalt, sodium, potassium, strontium, barium or aluminum.

"Smokeless" when referring to a gunpowder or gas generant means a propellant that emits little smoke upon firing and leaves only a minimum amount of solid, noncorrosive particulate residue in the weapon after firing.

Nitrocellulose is manufactured with various nitrogen contents. For the purposes of the broad aspects of this invention, any nitrocellulose composition having an operative nitrogen level that functions as a fuel in association with the provided oxidizer may be incorporated into the propellant composition. While commercially available nitrocellulose generally has a nitrogen content level of about 10% to about 14% by weight, it has been found, however, that a preferred nitrogen content level for the nitrocellulose is about 12.6% by weight.

The preferred organic oxidizer is guanidine nitrate, which has the added advantage of having salt-like physical characteristics in that it is granular and crystalline, which aid in processing of the propellant composition. Since guanidine nitrate is basically organic, it is an important contributor to approaching the desired goal of having substantially fully gaseous combustion products. It has been found, however, that the pressure-time profile produced from propellant formulations containing guanidine nitrate as the sole oxidizer are not equivalent to those produced by black powder or PYRODEX™ under similar firing conditions. The use of guanidine nitrate contributes to lowering the pressure exponent during the combustion cycle, thereby rendering the burning rate of the propellant less sensitive to chamber pressure. Less effective, although useful, substitutes for guanidine nitrate include ammonium nitrate or nitroguanidine or triaminoguanidine or diaminoguanidine, monoaminoguanidine, nitroaminotetrazole salts or any suitable organic oxidizer.

To improve the pressure-time profile of the propellant of aspects of the present invention, a relatively small amount of a secondary oxidizer, one that is mineral-based and powerful, such as potassium perchlorate, is incorporated into the mixture. While potassium perchlorate is preferred, other suitable mineral-based oxidizers (e.g., ammonium or any alkali metal nitrate, perchlorate, chlorate, peroxide or any alkaline earth metal nitrate) may be used. The addition of a selected quantity of such metal-based oxidizers (e.g., potassium perchlorate) raises the chamber temperature to a level considerably above that which would otherwise occur in the early stages of the combustion cycle, thereby encouraging the primary organic oxidizer to release its oxygen in a timely manner. The amount of secondary oxidizer is kept as low as possible, however, so that the chamber pressure developed during the full firing process and reaction will not rise too high for the weapon to withstand and to minimize the presence of particulate residues after firing.

On this basis, the invention according to one aspect is the formulation of a substitute propellant for black powder that incorporates an organic, cellulose-based fuel with an organic, non-azide, nitrogen-containing oxidizer as the principal oxidizer, with the presence, as a secondary oxidizer, of an oxygen-rich mineral-based oxidizer, preferably up to the limit of 2% by weight of the total weight of the organic fuel and organic oxidizer, or up to 20% by weight of the organic oxidizer.

TABLE 1

Chemical Composition for Organic Fuel, Principal Organic Oxidizer and Secondary Mineral Oxidizer

| Ingredient | Embodiment 1 (% by weight) | Embodiment 2 (% by weight) | Embodiment 3 (% by weight) |
|---|---|---|---|
| Nitrocellulose (12.6% $N_2$) | 70-90 | 75-85 | 82.7 |
| Guanidine Nitrate | 5-30 | 10-20 | 15.7 |
| Potassium Perchlorate | 0.5-10 | 0.8-2.0 | 1.6 |

According to other aspects of the invention, the ratios of fuel to two exemplary principal oxidizers are shown in Table 1.

Another aspect of the invention is the manner in which the bulk density and/or effective energy per unit volume of the propellant is adjusted to match the work done on the projectile by black powder in guns. While any method of forming grains from the composition of the present invention may be used (e.g., a pressed pellet, a shaped flaked-grain, or even rolled ball powder), it is preferred to use an extrusion machine to extrude the propellant composition of the present invention, preferably in tubular form and, more preferably, with a single longitudinal perforation or internal void. By so doing, design flexibility is achieved which, in part, includes a possible reduction of the effective energy per unit volume to match the work done on a projectile by black powder in guns. This design flexibility is obtained by varying the physical dimensions of the extruded hollow grains (length, diameter and wall thickness) in concert with the propellant formulation itself. The hollow tubular grains of preferred aspects of the present invention, in addition to their design flexibility, give more uniform ignitability.

As seen in FIG. 1 the extruded grain of the present invention is a hollow cylinder 10, i.e., having an outside diameter 11 of 0.040 to 0.070 inch (0.1016 to 0.1778 centimeters), preferably 0.050 inch (0.127 centimeters), an interior diameter of the single perforation 12 of 0.008 to 0.054 inch (0.02032 to 0.13716 centimeters), preferably 0.026 inch (0.06604 centimeters), a length of 0.030 to 0.200 inch (0.0762 to 0.508 centimeters), preferably 0.058 inch (0.14732 centimeters), and with a preferred length/diameter of 1.16. Preferred formulations for propellants according to aspects of the present invention are set forth in Table 2. In order to provide an extrudable composition, additional components provide desirable properties. The propellant includes, in small quantities, a plasticizer (e.g., acetyl triethyl citrate), a stabilizer (e.g., ethyl centralite), a lubricant (e.g., graphite), and one or more pigments to give a distinguishing colour for colour coding. When the guanidine nitrate is used as the non-azide, nitrogen-containing oxidizer and the composition is shaped to a specific geometric configuration (e.g., the configuration of FIG. 1), the effective energy content per unit volume of the composition is similar to that of black powder.

The desired bulk density of about 0.550 g/cc to about 0.750 g/cc is achieved by utilizing an extrusion method to manufacture the propellant grains. The resulting extruded grains are pourable like black powder, hence black powder volumetric measures can be used to set the powder load for both cartridges and muzzleloader applications. In addition, the extruded propellant grains exhibit low standard deviations associated with the metering of propellant charge weight, chamber pressure and projectile velocity.

TABLE 2

Chemical Formulations

| Ingredient | Embodiment 4 (% by weight) | Embodiment 5 (% by weight) | Embodiment 6 (% by weight) |
|---|---|---|---|
| Nitrocellulose (Grade A with 12.6% $N_2$) | 70-90 | 76-82 | 79.2 |
| Guanidine nitrate | 5-30 | 10-20 | 15.0 |
| Potassium perchlorate | 0.5-10 | 0.8-2.0 | 1.5 |
| Acetyl triethyl citrate | 1.0-4.0 | 2.0-3.0 | 2.0 |
| Ethyl centralite | 1.0-3.0 | 1.5-2.5 | 2.0 |
| Graphite | 0-0.8 | 0-0.3 | 0.2 |
| Pigments | As desired | As desired | 0.1 |

The graphite is a lubricant that aids the loading of cartridges and weapons, while the ethyl centralite is a stabilizer for the final product. Other NO scavenging substances (e.g., diphenylamine, akardite, 2-NO diphenylamine or methyl nitroaniline) can be used as stabilizers, but ethyl centralite is preferred.

Pigment is added to give the propellant a distinctive colour to distinguish it from other small caliber propellants or powders and to be useful for colour coding to identify different grades of propellant grains.

The graphite and pigments do not contribute significantly to the energy of the formulation. The ethyl centralite, which is mostly carbon, reacts with oxygen to provide further energy to the reaction.

In order to release all the energy available within the time of the combustion cycle, thereby emulating the performance of black powder, it is necessary to add a small amount of a powerful inorganic oxidizer (e.g., potassium perchlorate) to speed up the combustion process. The potassium perchlorate raises the chamber temperature to a level considerably above that for black powder or its mineral based substitutes in the early stages of the combustion cycle. This results in a pressure-time curve similar to that obtained when firing black powder or its mineral-based substitutes under the same conditions but without the smoke, degree of particulate residue and other disadvantages of black powder or its mineral-based substitutes.

In another embodiment of the present invention, the propellant is blended with certain ignition grains to overcome deficiencies with substandard or older weapon systems or in marginal firing conditions (eg., cold or humid weather). The ignition grains can be chosen from benite or other suitable ignition grains which have a geometry similar to that as the propellant of the invention. The ignition grains contain a larger proportion of mineral-based oxidizers as compared to organic oxidizers. The amount of oxidizer in the ignition grains is adjusted to match the ballistics properties of the propellant of the invention. In one embodiment, the same oxidizers as the secondary oxidizer of the propellant of the invention can be used in the ignition grains.

It has been found that the composition of the ignition grains which, initially, was designed, in combination with the propellant of the invention, to improve the propellant's ignition, such as with substandard or older weapon systems or in marginal firing conditions, can also be used alone as the propellant in a weapon system, in various firing conditions.

Several factors were found to influence the ignition capabilities of the ignition grains. The proportion of nitrocellulose of from about 30-60% by weight works well. The higher limit resulted in ignition when tested in several modern in-line muzzleloaders, whereas the lower limit was the minimum required the grains to bind adequately. Two grades of nitrocellulose (A and Cl) were tested, the Cl grade providing in better ignition due to its lower solubility and higher porosity, resulting in a more fragile matrix. With respect to the sulphur component, a relatively higher proportion was found to aid ignition, although this must be tempered due to increased combustion residue. The solvent, which can be an ether/alcohol mixture or acetone alcohol/mixture, has little or no influence on the ignition capability.

Given these observations, the ignition grains tested with the propellant of the present invention and alone comprised nitrocellulose in an amount from about 40 to 50% by weight, ethyl centralite in an amount from 0.2 to 0.8% by weight, potassium nitrate in an amount from about 36 to 46% by weight, sulphur in an amount from about 3.5 to 7.5% by weight, charcoal from about 5.5 to 10.5% by weight and other moisture and volatiles in an amount up to 1.0% by weight.

Manufacturing Method

An extrusion manufacturing method was chosen to shape the composition of aspects of the present invention into suitable grains having the desired bulk density and energy content on a volumetric basis. The object was to produce a tubular propellant grain having one or more central gaps, voids or openings of controlled dimension within the grain. Preferably, the propellant is extruded as strands in a tubular form with a hollow core (i.e., a longitudinal central perforation with a tubular shape), as shown in FIG. 1 as a preferred embodiment, which are then directly severed into small segments to create free-flowing individual grains.

The first step in the preparation of the preferred formulations detailed in Table 2 consists of dry mixing for a suitable time (e.g., about 10 minutes) the dehydrated nitro-cellulose (Grade A containing 12.6% nitrogen) with the guanidine nitrate, potassium chlorate and ethyl centralite. Ether and alcohol are then added as solvents along with the acetyl triethyl citrate. With 12.6% nitrogen content, the nitrocellulose is completely soluble in the ether/alcohol solvent solution. Wet mixing is then conducted for a suitable time (e.g., 30 minutes) with the mix temperature being gradually raised to about 30° C. The mix, which is now in the form of dough, is allowed to cool for a suitable time (e.g., about 20 minutes) to below about 20° C. as its rheology is adjusted for extrusion.

The second step in the manufacturing method is the extrusion of the dough form through dies of the desired shape (e.g., tubular with a single perforation) and dimensions. The diameter and perforation of the strands are closely monitored for uniformity. A rotary cutting machine cuts the strands immediately as they come out of the extruder into grains of fixed length. The geometry of the preferred embodiment of each of the grains is detailed in Table 3.

TABLE 3

Preferred Dimensions of Extruded Grain

| Grain Dimension | Size range (inch) | Size (inch) |
|---|---|---|
| Length (L) | 0.030-0.200 | 0.058 |
| | 0.0762-0.508 | 0.14732 |
| Outer Diameter (D) | 0.040-0.070 | 0.050 |
| | 0.1016-0.1778 | 0.127 |
| L/D | 0.8-2.8 | 1.16 |
| Grain wall thickness | 0.008-0.016 | 0.012 |
| | 0.02032-0.04064 | 0.03048 |
| Perforation Diameter (d) | 0.008-0.054 | 0.026 |
| | 0.02032-0.13716 | 0.06604 |

Next, the solvents are recovered by heating the cut propellant grains to between about 30° C. and about 45° C. for about 48 hours. The propellant grains are then coated with graphite using a glazing process before being dried (e.g., in tray driers) at about 55° C. to reduce volatile material below 1% by weight. Once dried, the grains are screened to remove clusters, undersized grains and dust. Following chemical analyses and ballistic evaluations, final blending completes production of the propellant.

Test Results

The test results from the propellant in one aspect of the present invention are compared to PYRODEX™ to demonstrate performance enhancement. Data for traditional smokeless propellants is also included to show the vastly different operating regimes between them and the propellant of aspects of the present invention. Thus, these test results are intended to show that the shaped propellant of an aspect of the present invention can replace not only black powder but also its mineral-based substitutes, since the mineral-based substitutes are of the greatest interest due to their predominance in the marketplace. The shaped propellant of aspects of the present invention is much less hygroscopic (<2% using the MIL-STD-286 method) than black powder and its mineral-based substitutes (>9% for PYRODEX™). It has been found that the shaped propellant of an aspect of the present invention leaves a greatly reduced amount of solid, particulate residue (in certain cases almost none) in guns after shooting (<1% of the total charge weight after 50 shots) compared to >30% for most mineral-based substitutes of black powder after only a few shots. It has been found that the little residue that does remain (generally in the form of a thin layer of soot or very small and light organic flakes) is mostly organic.

The preferred bulk density of the propellant of the invention is 0.664 g/cc compared to 0.667 g/cc for PYRODEX™, thereby assuring virtually identical powder loads for a given firearm and loading procedure. Thus, for example, the standard volumetric powder measure traditionally used by hand loaders for determining the exact quantity of powder (powder load) prior to loading a gun with black powder or its mineral-based substitutes, is equally applicable to the propellant grains of aspects of the present invention. Further, since the preferred propellant of aspects of the present invention is extruded, it has excellent loading properties which result in lower standard deviations related to ballistic performance.

Some test data are presented in the following Tables 4, 5 and 6 and in the graphs of FIGS. 2 and 3.

TABLE 4

Cartridge Applications

| Test Load | Powder Load (gr/mg) | PYRODEX ™ RS Select Velocity (fps/mps) | PYRODEX ™ RS Select Pressure (psi/kPa piezo) | Propellant of Invention Velocity (fps/mps) | Propellant of Invention Pressure (psi/kPa piezo) |
|---|---|---|---|---|---|
| 45-70 GVT | 50 | 1,107 | 13,325 | 1,114 | 14,117 |
| 300 gr HDY HP | 3240 | 337.4 | 91,872 | 339.5 | 97,333 |
| Win WLR primer | 70 | 1,347 | 16,480 | 1,476 | 18,638 |
| | 4536 | 410.6 | 113,626 | 449.9 | 128,504 |

TABLE 5

Cartridges Fired at Temperature Extremes

| Test Load | Temperature (° C.) | PYRODEX ™ RS Select Velocity (fps/mps) | PYRODEX ™ RS Select Pressure (psi/kPa piezo) | Propellant of Invention Velocity (fps/mps) | Propellant of Invention Pressure (psi/kPa piezo) |
|---|---|---|---|---|---|
| 45-70 GVT | −45 | 1,356 | 17,369 | 1,484 | 19,644 |
| 300 gr HDY HP | | 413.3 | 119,755 | 452.3 | 135,440 |
| Win WLR primer | 21 | 1,392 | 19,712 | 1,509 | 20,415 |
| 70 gr powder load | | 424.3 | 135,909 | 459.9 | 140,756 |
| | 45 | 1,377 | 17,442 | 1,516 | 19,087 |
| | | 419.7 | 120,258 | 462.1 | 131,600 |

TABLE 6

Modern in-line muzzleloader Applications

| Test load | Powder Load (gr/mg) | PYRODEX ™ RS Velocity (fps/mps) | PYRODEX ™ RS Pressure (psi/kPa strain gauge) | Propellant of Invention Velocity (fps/mps) | Propellant of Invention Pressure (psi/kPa strain gauge) |
|---|---|---|---|---|---|
| .50 cal CVA Optima | 70 | 1,533 | 8,229 | 1,339 | 4,305 |
| RB .490/177 gr | 4536 | 467.2 | 56,737 | 408.1 | 29,682 |
| Fed 209 primer | 100 | 1,766 | 6,962 | 1,674 | 5,811 |
| | 6480 | 538.3 | 48,001 | 510.2 | 40,065 |
| | 130 | 1,922 | 9,635 | 1,983 | 7,812 |
| | 8424 | 585.8 | 66,431 | 604.4 | 53,862 |

Figure 2:
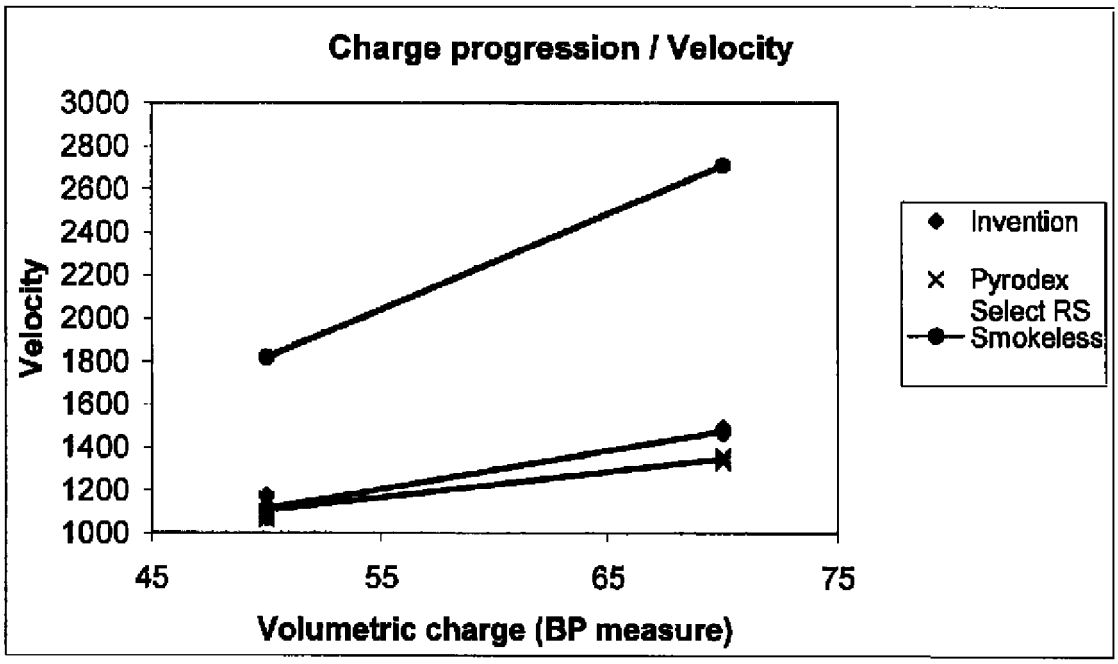
FIG. 2 is a graph of the ballistic performance of the invention compared with PYRODEX™ and smokeless propellant in terms of projectile velocity achieved as a function of the quantity of propellant charge or load employed.
Figure 3:
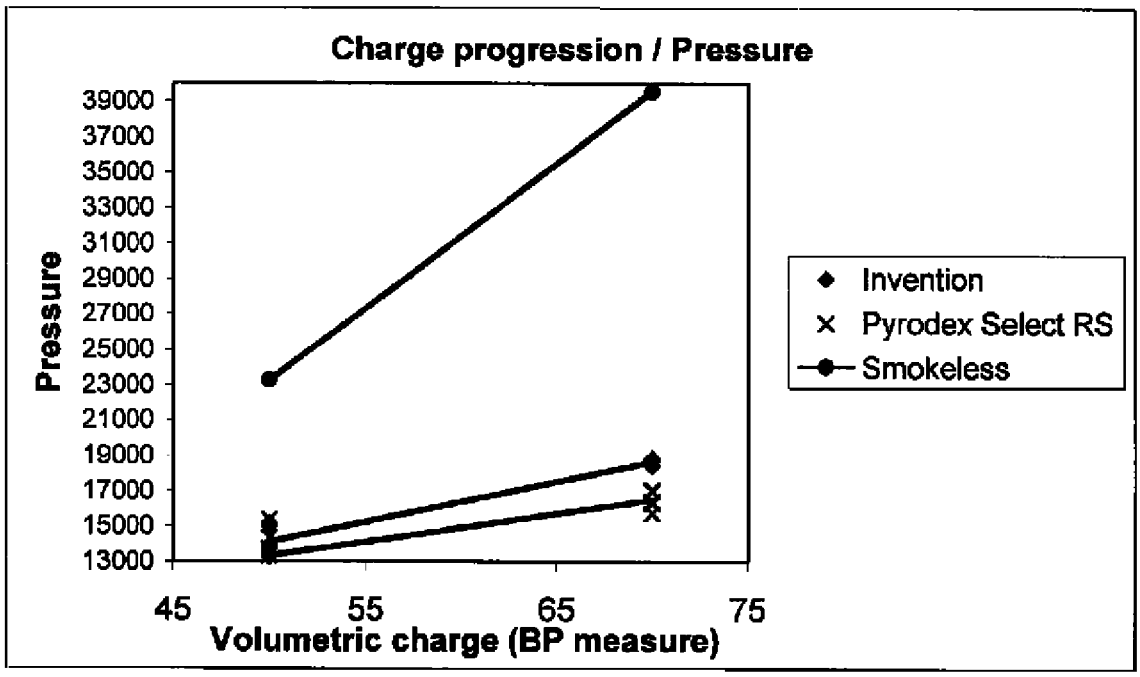
FIG. 3 is a graph of the ballistic performance of the invention compared with PYRODEX™ and smokeless propellant in terms of barrel pressure achieved as a function of the quantity of propellant charge or load employed.

The graphs in FIGS. 2 and 3 show that the ballistic performance (velocity and pressure respectively) of the propellant of an aspect of the present invention has similar velocity and pressure progressions compared to those for PYRODEX™ for the same powder load variation. In other words, the ballistic test results associated with the shaped propellant of an aspect of the present invention are similar to those for PYRODEX™ Select RS under identical firing conditions.

As can be seen in Tables 4 and 5, both the velocities and the pressures are higher for the propellant of the invention compared to PYRODEX™ Select RS. This can be attributed to the higher calorimetric value of the shaped propellant of the present invention (813 cal/g compared to approximately 700 cal/g for PYRODEX™ Select RS) and by its more uniform ignition and burning characteristics. Further, the standard deviations are very low for both velocity and pressure in the modern in-line muzzleloader and cartridge case weapons. The shaped propellant of aspects of the present invention is also less sensitive to velocity and pressure variations when the guns are fired at extreme temperatures.

As seen in Table 6, the data for modern in-line muzzleloader applications follows different trends because it has been compared to PYRODEX™ RS; a lower quality grade of PYRODEX™ that yields less grain uniformity and higher pressure in the gun than PYRODEX™ Select RS. In fact, the pressure slope of the shaped propellant of the present invention, in terms of pressure variation with charge weight, is lower than the compared propellant of the prior art, and the velocity progression is higher, in terms of muzzle velocity as a function of powder load. That means more safety for the user combined with higher ballistic performance. The shaped propellant of aspects of the present invention yields the same safety features as black powder or its mineral substitutes in the designated application. These features are related to the low sensitivity of its burning rate to the pressure.

Test firing results show that bullets propelled by the shaped propellant of an aspect of the present invention not only are precise, but also are consistent within a group fired from the same weapon without interruption for cleaning. Tests were conducted in good and poor weather conditions.

In one set of tests with Hornady XTP 50/44 300 gr bullets (19.4 grams) in conjunction with the shaped propellant of an aspect of the present invention, in a closed breech 209 primer ignition system and an iron (open) sight, the first three rounds had a 0.5-inch (1.27 centimeters) grouping at 30 yards (27.432 meters) and a 6 inch (15.24 centimeters) grouping at 150 yards (137.16 meters). A similar test with PYRODEX™ showed that the spread increased with the number of firings due to the rapid build-up of solid residue in the barrel compared to the clean firings of the propellant of the invention. In fact, after 42 uninterrupted firings with the shaped propellant of aspects of the present invention, only a thin film of soot with no build up of solid residue was observed in the barrel.

Figure 4:
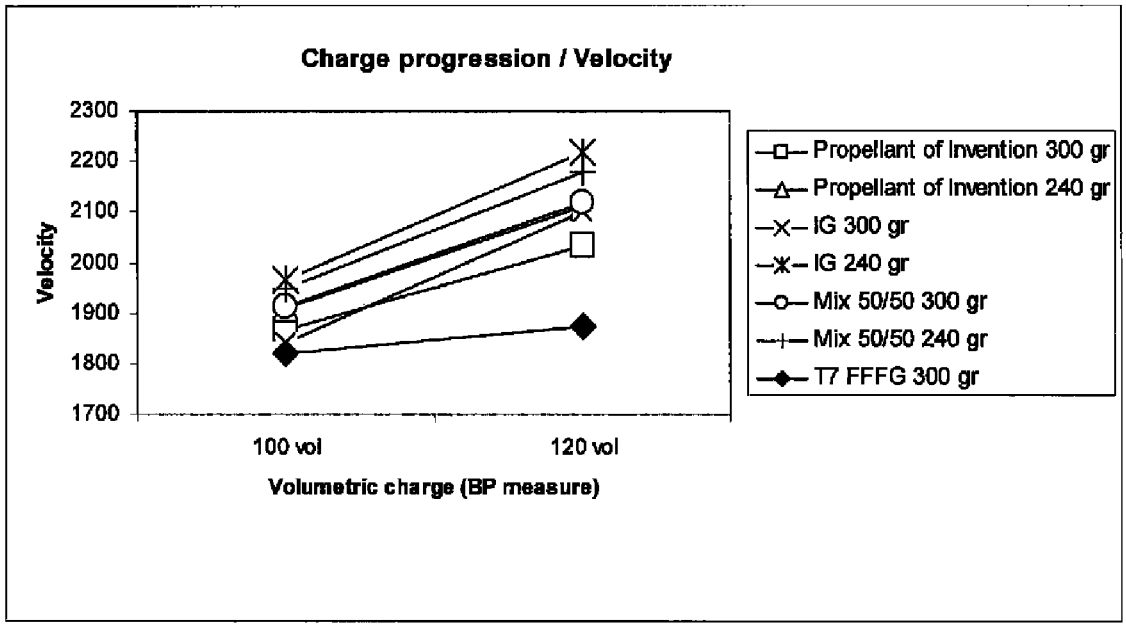
FIG. 4 is a graph of the ballistic performance of the propellant, ignition grains and a mixture thereof of the invention compared with TRIPLE 7™ in terms of projectile velocity achieved as a function of the quantity of charge or load employed.
Figure 5:
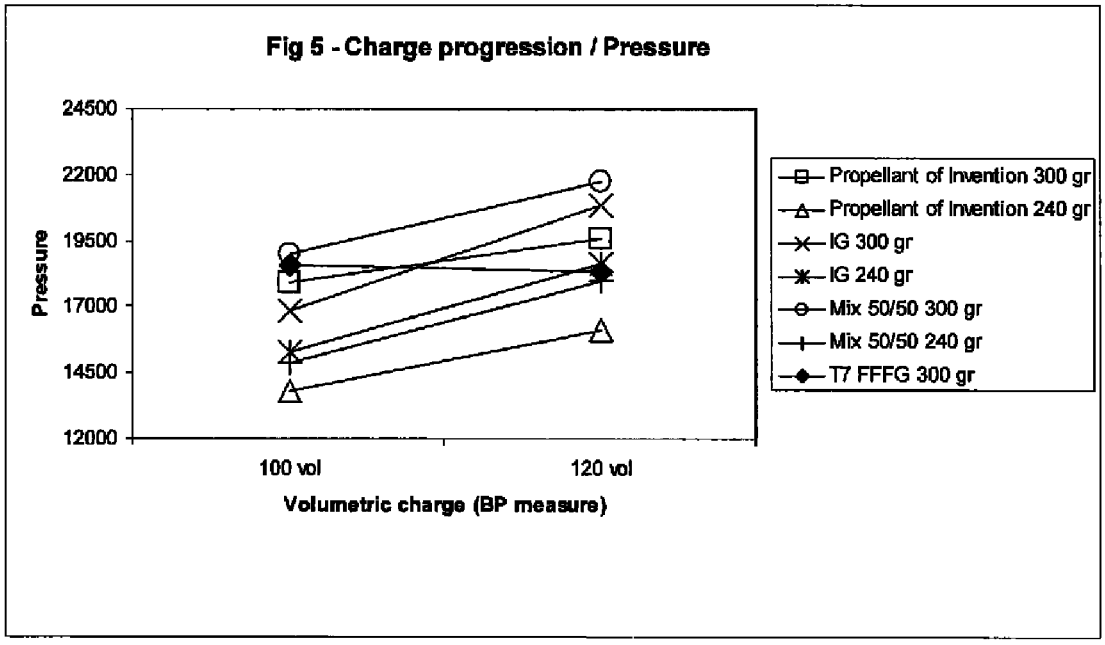
FIG. 5 is a graph of the ballistic performance of the propellant, ignition grains and a mixture thereof of the invention compared with TRIPLE 7™ in terms of barrel pressure achieved as a function of the quantity of charge or load employed.
Figure 6:
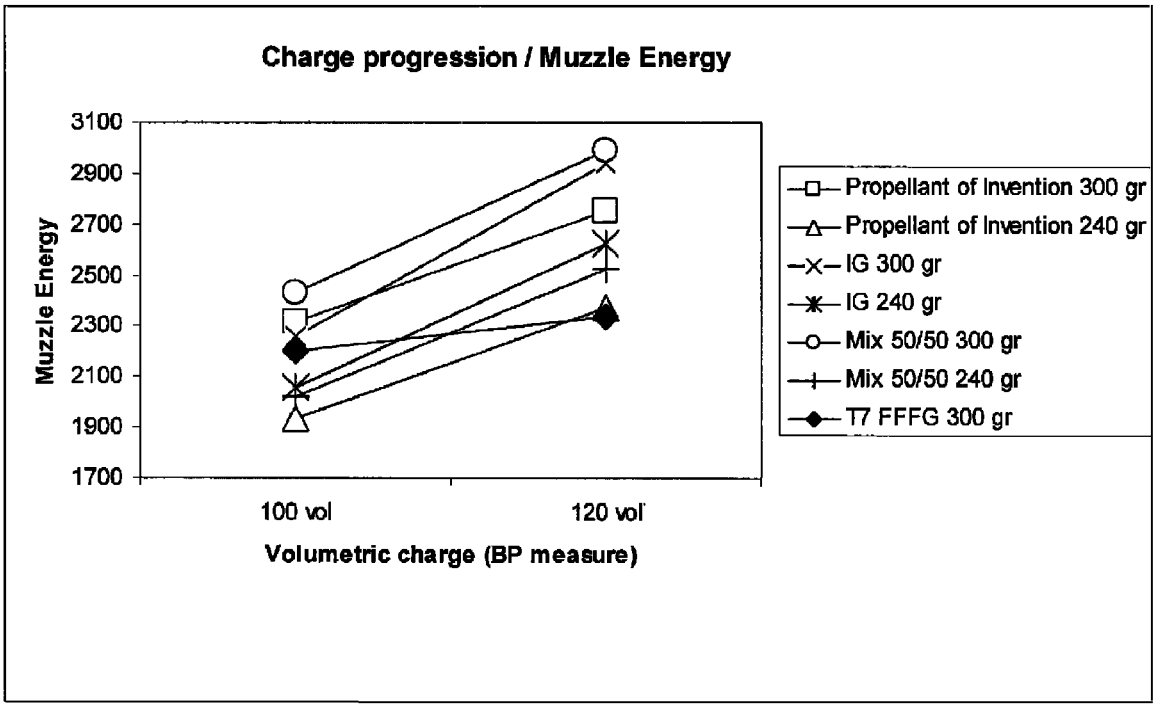
FIG. 6 is a graph of the ballistic performance of the propellant, ignition grains and a mixture thereof of the invention compared with TRIPLE 7™ in terms of the muzzle energy achieved as a function of the quantity of charge or load employed.

Further field tests were conducted in ambient conditions with an embodiment of the propellant of the present invention, an approximate 50-50 mixture of the propellant with ignition grains of the present invention (ie, in a 1:1 ratio), pure ignition grains of the present invention and TRIPLE 7 FFFG™, a known fast-burning propellant manufactured by Hodgdon, as detailed in Table 7 and FIGS. 4 to 6. The projectile weight (240 gr (15.55 grams) and 300 gr (19.44 grams)) is indicated for the tested propellants.

In comparison with TRIPLE 7 FFFG™, the propellant, ignition grains and 50-50 mixture of the present invention all showed similar velocity and pressure progressions for the same powder load variation. The data in Table 7 further compares the projectile energy from the 0.308 Winchester™ using a standard smokeless propellant for this caliber and projectile (IMR4895), with the tested powders.

The Powerpunch™ 600 gr (38.88 grams) is a known heavy projectile used for 0.50 cal muzzleloading. The pressure generated with this projectile using a fast-burning propellant (TRIPLE 7 FFFG™) was used as the maximum pressure criteria (P+3 SD) to establish the safety of the tested propellants.

As shown in Table 7 and FIGS. 4-6, the velocities are higher for each tested powder compared to TRIPLE 7 FFFG™. The velocity standard deviations for the same projectile (300 gr (19.44 grams)) are lower compared to that of TRIPLE 7 FFFG™. The muzzle energy and pressure progressions are comparable to TRIPLE 7 FFFG™. Furthermore, the muzzle energy measured from the tested propellants are comparable to that of the 0.308 Win. The pressure standard deviations for the same projectile (300 gr (19.44 grams)) are very much lower compared to that of TRIPLE 7 FFFG™. The maximum pressure threshold for each of the tested propellants did not exceed the pressure generated with the propellant of the prior art (23877 psi (164,626 kPa)), thereby establishing its safety.

Cold weather tests (at 9° F. (−12.8° C.)) were also conducted and yielded consistent firing results in four different weapons, all with CCI 209 shotshell primer. The two powders tested were the propellant of the invention and an approximate 50-50 mixture of the propellant with the ignition grains of the present invention.

TABLE 7

Ballistic Summary in Ambient Conditions

| Powder | Charge | Projectile | Velocity (fps/mps) | Velocity SD (fps/mps) | Muzzle energy (ft × lb/J) | Pressure (psi/kPa) | Pressure SD (psi/kPa) | P + 3 SD (psi/kPa) |
|---|---|---|---|---|---|---|---|---|
| IMR | 45 wt | 308 Win/180 gr | 2500 | | 2497 | 52000 | | |
| 4895 | | (11.66 grams) | 762 | | 3385.5 | 358527 | | |
| Triple 7 | 120 vol | Powerpunch 600 gr | 1486 | | 2941 | 23877 | | |
| FFFG | | (38.88 grams) | 452.9 | | 3987.5 | 164626 | | |
| Triple 7 | 100 vol | Hdy SST 300 gr | 1819 | 31 | 2203 | 18564 | 4874 | 33186 |
| FFFG | | (19.44 grams) | 554.4 | 9.4 | 2986.9 | 127994 | 33605.0 | 228809.4 |
| | 120 vol | Hdy SST 300 gr | 1875 | 24 | 2341 | 18320 | 1660 | 23300 |
| | | (19.44 grams) | 571.5 | 7.3 | 3174.0 | 126312 | 11445.3 | 160647.8 |
| Propellant | 100 vol | Hdy XTP 300 gr | 1866 | 27 | 2319 | 17900 | 677 | 19931 |
| of | | (19.44 grams) | 568.8 | 8.2 | 3144.1 | 123416 | 4667.8 | 137419.4 |
| Invention | 120 vol | Hdy XTP 300 gr | 2035 | 19 | 2758 | 19617 | 580 | 21357 |
| | | (19.44 grams) | 620.3 | 5.8 | 3739.3 | 135254 | 3999.0 | 147251.3 |
| Ignition | 100 vol | Hdy XTP 300 gr | 1843 | 18 | 2262 | 16816 | 514 | 18358 |
| Grains | | (19.44 grams) | 561.7 | 5.5 | 3066.9 | 115942 | 3543.9 | 126574.0 |
| | 120 vol | Hdy XTP 300 gr | 2102 | 16 | 2942 | 20837 | 184 | 21389 |
| | | (19.44 grams) | 640.7 | 4.9 | 3988.8 | 143666 | 1268.6 | 147472.0 |
| Mix | 100 vol | Hdy SST 300 gr | 1912 | 21 | 2434 | 18975 | 822 | 21441 |
| 50/50 | | (19.44 grams) | 5818 | 6.4 | 3300.1 | 130828 | 5667.5 | 147830.5 |
| | 120 vol | Hdy SST 300 gr | 2120 | 9 | 2993 | 21748 | 540 | 23368 |
| | | (19.44 grams) | 646.2 | 2.7 | 4058.0 | 149947 | 3723.2 | 161116.7 |
| Propellant | 100 vol | Hdy XTP 240 gr | 1908 | 29 | 1939 | 13794 | 1127 | 17175 |
| of | | (15.55 grams) | 581.6 | 8.8 | 2628.9 | 95106 | 7770.4 | 118417.5 |
| Invention | 120 vol | Hdy XTP 240 gr | 2112 | 40 | 2376 | 16133 | 1323 | 20102 |
| | | (15.55 grams) | 643.7 | 12.2 | 3221.4 | 111233 | 9121.8 | 138598.4 |
| Ignition | 100 vol | Hdy XTP 240 gr | 1967 | 15 | 2061 | 15264 | 385 | 16419 |
| Grains | | (15.55 grams) | 599.5 | 4.6 | 2794.3 | 105242 | 2654.5 | 113205.0 |
| | 120 vol | Hdy XTP 240 gr | 2220 | 31 | 2626 | 18613 | 832 | 21109 |
| | | (15.55 grams) | 676.7 | 9.4 | 3560.4 | 128332 | 5736.4 | 145541.4 |
| Mix | 100 vol | Hdy XTP 240 gr | 1948 | 43 | 2022 | 14844 | 1075 | 18069 |
| 50/50 | | (15.55 grams) | 593.8 | 13.1 | 2741.5 | 102346 | 7411.9 | 124581.4 |
| | 120 vol | Hdy XTP 240 gr | 2178 | 21 | 2527 | 17988 | 868 | 20592 |
| | | (15.55 grams) | 663.9 | 6.4 | 3426.2 | 124023 | 5984.6 | 141976.8 |

The propellant was loaded in the CVA Kodiak™ TC Omega™, Knight Bighorn™ and Tradition Tracker™ firearms. The Kodiak™ and the Omega™ were scope equipped; shooting Hdy XTP 50/45 240 gr bullet/sabot (15.55 grams) with 90 grains (5.83 grams) of the propellant of the present invention at 100 yards (91.44 meters). On a 10 round string, every single shot ignited well and struck the target with a 5 inch (12.7 centimeters) grouping without any work on the load, which is good given the equipment temperature and shooter conditions. Very little residue was observed at the end of the session. The guns were cleaned with two patches and the breech plug was removed with little effort.

The Knight Bighorn™ and the Tradition Tracker™ were shot with open sight at 50 yards (45.72 meters) with White 320 grains bullet/sabot (20.74 grams) and 90 grains (5.83 grams) of the 50-50 mixed powder. On a 5 round string, every single shot ignited well and struck the target with a grouping between under 2 and 4 inches (5.08 to 10.16 centimeters). While it was observed that the shots with the 50-50 mixture yielded slightly more smoke than pure propellant, the degree was much less than that of current black powder substitutes. At the end of the session, the guns were cleaned with 2-3 patches and the breech plug was removed without any effort.

Even in extreme hunting weather, the firearms using the propellant and propellant-ignitor grain mixture of the present invention did not foul. The residue that remained after all shots were fired was easily and quickly cleaned. Very little smoke was emitted during firing.

Further field ignition tests of various other mixtures of propellant and ignition grains were conducted. It was found that a mixture of a minimum of 35% of ignition grains with the propellant of the invention yields similar ignition results with various weapons, including substandard or older weapon systems.

CONCLUSION

The foregoing has constituted a description of specific embodiments showing how the invention may be applied and put into use. These embodiments are only exemplary. The invention in its broadest, and more specific aspects, is further described and defined in the claims which now follow.

The invention claimed is:

1. Shaped propellant grains in the form of a propellant charge having a bulk density in the range of 0.550 to 0.750 grams per cubic centimeter, the propellant grains comprising a propellant composition for use in modern in-line muzzleloaders, wherein the propellant composition comprises:

a) from about 70 to about 90% by weight of a cellulose-based organic fuel;

b) from about 5 to about 30% by weight of a non-azide, nitrogen-containing, solid primary organic oxidizer; and c) from about 0.5% to about 10.0% by weight of a mineral-based secondary nitrate, perchlorate, chlorate or peroxide oxidizer, wherein, when used in said modern in-line muzzleloaders the products of combustion are substantially-completely gaseous, with the proviso that the propellant composition excludes nitroglycerin.

2. Shaped propellant grains in the form of a propellant charge having an energy per unit volume in the range of 400 to 700 calories per cubic centimeter, the propellant grains comprising a propellant composition for use in modern in-line muzzleloaders, wherein the propellant composition comprises:

a) from about 70 to about 90% by weight of a cellulose-based organic fuel;

b) from about 5 to about 30% by weight of a non-azide, nitrogen-containing, solid primary organic oxidizer; and c) from about 0.5% to about 10.0% by weight of a mineral-based secondary nitrate, perchlorate chlorate or peroxide oxidizer wherein when used in said modern in-line muzzleloaders the products of combustion are substantially-completely gaseous, with the proviso that the propellant composition excludes nitroglycerin.

3. Shaped hollow cylindrical propellant grains having: a) a length in the range 0.030 to 0.200 inch, b) a diameter in the range 0.040 to 0.070 inch, and having c) a coaxial opening there through having a wall grain thickness in the range 0.008 to 0.016 inch, the propellant grains comprising a propellant composition for use in modern in-line muzzleloaders, wherein the propellant composition comprises:

a) from about 70 to about 90% by weight of a cellulose-based organic fuel;

b) from about 5 to about 30% by weight of a non-azide, nitrogen-containing, solid primary organic oxidizer; and c) from about 0.5% to about 10.0% by weight of a mineral-based secondary nitrate, perchlorate, chlorate or peroxide oxidizer, wherein, when used in said modern in-line muzzleloaders the products of combustion are substantially-completely gaseous, with the proviso that the propellant composition excludes nitroglycerin.

4. The shaped hollow cylindrical propellant grains as claimed in claim 3 which are coated with graphite.

5. The shaped hollow cylindrical propellant grains as claimed in claim 3 having:

a) a length of about 0.058 inch, b) a diameter of about 0.050 inch, and c) a coaxial opening there through having a wall grain thickness of about 0.012 inch.

6. The shaped hollow cylindrical propellant grains as claimed in claim 5 which are coated with graphite.

* * * * *

UNITED STATES PATENT AND TRADEMARK OFFICE

CERTIFICATE OF CORRECTION

PATENT NO. : 8,257,522 B2
APPLICATION NO. : 13/326931
DATED : September 4, 2012
INVENTOR(S) : Mathieu Racette et al.

It is certified that error appears in the above-identified patent and that said Letters Patent is hereby corrected as shown below:

On the title page, item [62] should read:

"This application is a divisional of commonly owned U.S. Utility Patent Application Serial No. 12/278,866; now U.S. Patent No. 8,133,335 entitled: BLACK POWDER SUBSTITUTES FOR SMALL CALIBER FIREARMS, which is a 371 of PCT/CA07/00176, which was filed based on U.S. Provisional Application 60/771,443, this Utility Patent Application incorporated by reference herein."

Signed and Sealed this
Twenty-third Day of October, 2012

David J. Kappos

David J. Kappos
*Director of the United States Patent and Trademark Office*